US010060393B2

(12) United States Patent
Kragh

(10) Patent No.: US 10,060,393 B2
(45) Date of Patent: Aug. 28, 2018

(54) PURGE VALVE AND FUEL VAPOR MANAGEMENT SYSTEM

(71) Applicant: Ford Global Technologies, LLC, Dearborn, MI (US)

(72) Inventor: Niels Christopher Kragh, Commerce Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 988 days.

(21) Appl. No.: 13/764,624

(22) Filed: Feb. 11, 2013

(65) Prior Publication Data

US 2014/0224225 A1 Aug. 14, 2014

(51) Int. Cl.
*F02M 33/04* (2006.01)
*F02M 25/08* (2006.01)
(Continued)

(52) U.S. Cl.
CPC .. *F02M 25/0836* (2013.01); *F02M 35/10222* (2013.01); *F02D 9/02* (2013.01);
(Continued)

(58) Field of Classification Search
CPC ..... F02D 2009/0213; F02D 19/0621; F02D 41/003; F02D 41/0032; F02D 41/0037; F02D 41/004; F02D 41/0042; F02D 41/0045; F02D 25/0836; F02D 25/0854; F02D 25/0872; F02D 25/089; F02D 9/02; F02D 41/005; F02M 25/0836; F02M 25/08; F02M 26/71; F02M 35/10222; F02M 26/05; F02M 26/06
(Continued)

(56) References Cited

U.S. PATENT DOCUMENTS 3,541,784 A * 11/1970 Haase ..... F02B 37/12 123/559.1
4,630,575 A * 12/1986 Hatamura ..... F02M 25/089 123/184.48
(Continued)

FOREIGN PATENT DOCUMENTS

DE 102010025561 * 1/2012 ..... F02M 25/089
JP 2001227421 A * 8/2001
JP 2001227421 A * 8/2001

OTHER PUBLICATIONS

Kragh N. et al., "Evaporative Emission Control," U.S. Appl. No. 13/670,675, filed Nov. 7, 2012, 42 pages.
(Continued)

*Primary Examiner* — Mahmoud Gimie
*Assistant Examiner* — Josh Campbell
(74) *Attorney, Agent, or Firm* — Julia Voutyras; McCoy Russell LLP

(57) ABSTRACT

A purge valve and a fuel vapor management system for use with an engine emission control system are disclosed. The purge valve may include a first inlet for receiving a first flow of air from an air cleaner, a second inlet for receiving a second flow of purge vapors from an evaporative canister, and an outlet directing a controlled mixture of the first and second flows to an engine, upstream of an intake throttle. Relative amounts of the first flow and second flow may be selectively controlled by varying a position of the valve.

18 Claims, 5 Drawing Sheets

(51) Int. Cl.

| | |
|---|---|
| ***F02M 35/10*** | (2006.01) |
| *F02D 19/06* | (2006.01) |
| *F02D 41/00* | (2006.01) |
| *F02D 9/02* | (2006.01) |
| *F02M 26/71* | (2016.01) |
| *F02M 26/05* | (2016.01) |
| *F02M 26/06* | (2016.01) |

(52) U.S. Cl.
CPC ..... *F02D 19/0621* (2013.01); *F02D 41/003* (2013.01); *F02D 41/004* (2013.01); *F02D 41/005* (2013.01); *F02D 41/0032* (2013.01); *F02D 41/0037* (2013.01); *F02D 41/0042* (2013.01); *F02D 41/0045* (2013.01); *F02D 2009/0213* (2013.01); *F02M 25/08* (2013.01); *F02M 26/05* (2016.02); *F02M 26/06* (2016.02); *F02M 26/71* (2016.02)

(58) Field of Classification Search
USPC ..... 123/520, 518–519, 698, 198 D; 95/143
See application file for complete search history.

(56) References Cited

U.S. PATENT DOCUMENTS 5,172,672 A * 12/1992 Harada ..... F02M 25/0809 123/198 D
5,190,015 A * 3/1993 Nakata ..... F02D 41/004 123/518
5,226,397 A * 7/1993 Zabeck ..... F02M 25/0836 123/516
5,375,579 A * 12/1994 Mukai ..... F02M 25/089 123/516
5,609,135 A * 3/1997 Ogawa ..... F02D 41/0042 123/325
5,727,532 A 3/1998 Everingham et al.
6,044,831 A * 4/2000 Takagi ..... F02D 41/0032 123/520
6,152,115 A * 11/2000 Busato ..... F02M 25/0836 123/520
6,363,921 B1 * 4/2002 Cook ..... F02M 25/0809 123/519
6,695,895 B2 2/2004 Hyodo et al.
7,168,417 B2 * 1/2007 Arruda ..... B01D 53/0415 123/184.57
2002/0017270 A1 * 2/2002 Atago ..... F02B 17/005 123/295
2002/0139173 A1 * 10/2002 Kano ..... F02M 25/0809 73/49.7
2003/0226549 A1 * 12/2003 Takagi ..... F02M 25/0818 123/520
2004/0255912 A1 * 12/2004 Veinotte ..... F02B 23/104 123/520
2005/0011185 A1 * 1/2005 Annoura ..... F02D 41/0032 60/289
2007/0163550 A1 * 7/2007 Mai ..... F02M 25/08 123/520
2007/0186910 A1 * 8/2007 Leone ..... F02M 25/08 123/520
2007/0227515 A1 * 10/2007 Uchida ..... F02M 25/089 123/520
2010/0218749 A1 * 9/2010 Fornara ..... F02M 25/0836 123/520
2010/0224171 A1 * 9/2010 Peters ..... F02M 25/089 123/520
2011/0100470 A1 * 5/2011 Vogus ..... B65B 29/10 137/1
2011/0120432 A1 * 5/2011 Ulrey ..... F02D 9/12 123/568.15
2011/0162626 A1 * 7/2011 Styles ..... F02B 47/08 123/568.21
2012/0016566 A1 * 1/2012 Cunningham ..... F02D 37/02 701/103

OTHER PUBLICATIONS

Kragh N., "System and Method for Gas Purge Control," U.S. Appl. No. 13/852,785, filed Mar. 28, 2013, 31 pages.

* cited by examiner

PURGE VALVE AND FUEL VAPOR MANAGEMENT SYSTEM

FIELD

The present application relates to an emission control system wherein a valve is located on the induction path having a first inlet for atmospheric induction air and a second inlet for purge vapor from an EVAP canister.

BACKGROUND AND SUMMARY

Many vehicle emissions control systems include an evaporative canister, or EVAP canister configured to absorb fuel vapors from the fuel tank during some engine operational modes, such as when the engine is off, and/or during refueling. Typically the EVAP canister is fluidically coupled with the fuel tank and has an internal surface coated with a substance, such as activated charcoal, effective at absorbing the vapors. The canister may be purged during other engine operational modes in order to make the absorbing surfaces available to absorb more fuel vapor. During purge operations the vacuum pressure of the intake manifold is used to pull atmospheric air through the canister and into the engine combustion chamber.

The inventors herein have recognized that some engine technologies, for example newer, and/or proposed technologies, may run at low vacuum or near atmosphere pressure as measured post throttle body in the engine's intake manifold. This may result in insufficient air flow to sufficiently purge the hydrocarbons that are stored in a conventional evaporative system and carbon canister. U.S. Pat. No. 6,695,895 also recognizes the potential shortcomings presented by low intake manifold vacuum. The disclosure proposes to make up for insufficient negative pressure in the intake pipe by providing a purge pump on an atmospheric port side or on a purge port side, and increasing the pressure at the side of the atmospheric port of the canister or increasing the negative pressure at the side of the purge port so as to accelerate the supply of air into the canister.

The inventors herein have recognized a number of problems with this approach. For example, the approach requires adding a pump and thereby adding additional cost and complexity to the engine.

The present disclosure has at least partially addressed these problems, and provides additional advantages. The present disclosure may provide a purge valve for use in a fuel combustion engine. The purge valve may include a first inlet for coupling with an air cleaner to receive a first flow from the air cleaner, and a second inlet for coupling with an evaporative canister to receive a second flow from the evaporative canister. The purge valve may have an outlet that may be fluidically coupled to an upstream side of a throttle providing a fluid path to a combustion chamber of the engine. A controller may be configured to selectively control relative amounts of the first flow and the second flow which are allowed to pass through the outlet and to the combustion chamber.

The present disclosure may also provide a valve for an engine. The valve may have a first inlet for receiving atmospheric air as a first flow, and a second inlet for receiving a purge flow from an evaporative canister as a second flow. The evaporative canister may be fluidically coupled with a fuel tank and may be configured for absorbing fuel vapor. The purge flow may include desorbed fuel vapor. The valve may also have an outlet for directing a selected mixture of the first flow and the second flow to a combustion chamber of the engine. In some cases the outlet may be coupled with an induction air passage upstream from a throttle. In some cases the outlet may be coupled with an induction air passage upstream from a turbo compressor.

The present disclosure may also provide a fuel vapor management system for an engine. The fuel vapor management system may include an evaporative canister including a fuel vapor absorbing material. The system may also include a turbo compressor on an induction air path for compressing an induction fluid before the induction fluid is passed to an intake manifold of the engine. A valve may be located on the induction air path upstream from the turbo compressor, and may have a first inlet to receive a first flow, and having a second inlet to receive a second flow from the evaporative canister. The valve may be controllable to adjust relative amounts of the first flow and the second flow to pass to the turbo compressor.

In this way even in conditions of low vacuum within the intake manifold, a sufficient pressure differential may be obtained across the evaporative canister. In this way, effective purging of the absorbed fuel vapors may be achieved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1A:
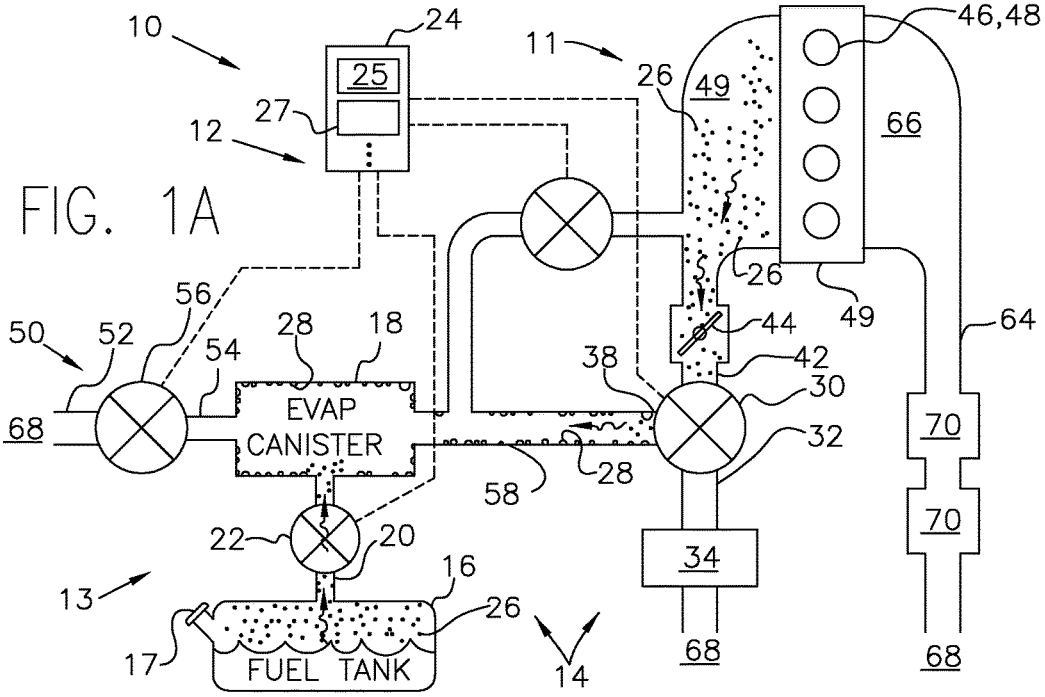
FIGS. 1A through 1D are schematic diagrams illustrating four example operating conditions of an example embodiment of an engine system in accordance with the current disclosure.

FIGS. 1A through 1D are schematic diagrams illustrating four example operating conditions of an engine system 12 in accordance with the current disclosure. The engine system 12 shown in each figure may include an engine 11, which may be included in, or with, a vehicle system 10. The engine system 12 may be coupled with, or include, a fuel system 13. The fuel system 13 may include a fuel vapor management system 14 including a fuel tank 16, and an evaporative canister 18 fluidically coupled with the fuel tank 16 such that fuel vapor may migrate, or be routed, from the fuel tank 16 to the evaporative canister 18 via conduit 20 and may be absorbed by a fuel vapor absorbing material included within the evaporative canister 18. The fuel vapor absorbing material may be, or may include, activated carbon or the like, and may be, configured, for example, as a coating on the inside surface of the evaporative canister 18. Conduit 20 may optionally include a fuel tank isolation valve 22 that may be configured to open to allow fluidic communication between the fuel tank 16 and the evaporative canister 18, or closed to prevent communication therebetween.

The fuel tank isolation valve 22 may be actuated by, or have actuation caused by, an engine controller 24. Actuation of isolation valve 22 may be responsive to one or more signals from one or more sensors and/or one or more user, for example driver, inputs. The one or more signals and/or inputs may first be processed in accordance with predetermined logistical rules and/or software by the engine controller 24 which may result in predetermined actuation of the isolation valve 22. The engine controller 24 may also be configured to receive various signals from various other sensors throughout the engine system 12 and/or user inputs, and may be configured to actuate, or cause actuation of, various other mechanisms, such as other valves some of which are discussed below.

The controller 24 may include a number of different modules, or logistical units, and may be operatively coupled with, or included with, an engine control unit. For example the controller 24 may include a powertrain control module (PCM) 25 included as a part of the controller 24 or coupled with the controller 24 to control the relative amounts of the first flow and the second flow. Other modules 27 may also be included as part(s) of the controller 24. The controller 24 may be responsive to selected engine conditions determined by one or more sensors. The controller 24 may include memory or logic with instructions for carrying out the various methods and actions described herein.

In other embodiments adjustment of the valve 30 to control relative amounts of the first flow 36 and the second flow 40 may be controlled by other means that may not include the controller 24. In some embodiments the controller 24 may be a set of actuators, and/or controls arranged in a discrete location, or they may instead be arranged in a non-localized fashion having components located in various locations in the engine system 12.

FIG. 1A illustrates an example operating condition that may be referred to as absorption in that evaporative canister 18 may absorb fuel vapor. Small circles are included in the figure to schematically represent fuel vapor 26, and semicircles in contact with various object sides to represent fuel vapor absorbed 28 by example absorbing surfaces. In this example operational condition the engine system 12 may be off.

Under some operating conditions, such as during refueling, fuel vapors 26 present in the fuel tank 16 may be displaced when fuel is added to the tank 16 via fuel filler cap 17. The displaced air and/or fuel vapors 26 may be routed from the fuel tank 16 to the fuel vapor, i.e. evaporative canister 18, and then to the atmosphere 68 through vent 50. In this way, an increased amount of vaporized hydrocarbons (HCs) may be stored in evaporative canister 18.

Figure 1B:
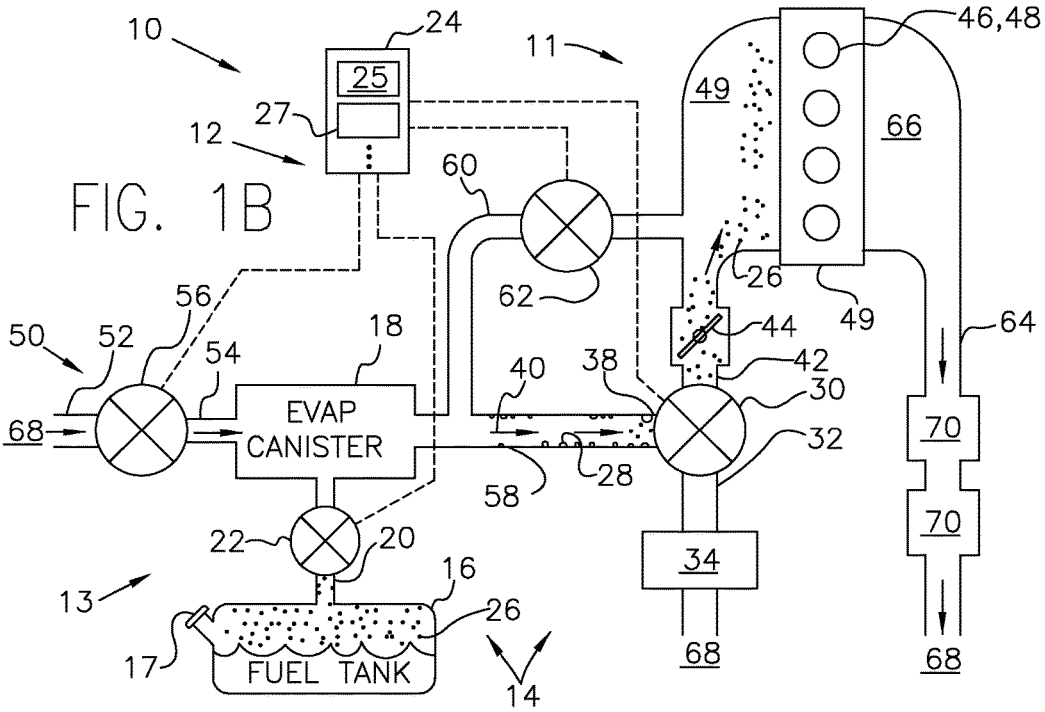

FIG. 1B illustrates an example purging operating condition. In order to clear the absorbed fuel vapor 28 from the evaporative canister 18 and to avoid allowing the fuel vapor 26 to enter the atmosphere the absorbed fuel vapor 28 may be purged from the evaporative canister 18 in one or more selected purge operations. Embodiments in accordance with the current disclosure may include a purge valve 30 for use in a fuel combustion engine 11. The purge valve 30 may include a first inlet 32 for coupling with a filter or air cleaner 34 to receive a first flow 36 (see FIG. 1C) from the air cleaner 34. A second inlet 38 may be included for coupling with the evaporative canister 18 to receive a second flow 40 from the evaporative canister 18. The valve 30 may also have an outlet 42 fluidically coupled to an upstream side of a throttle 44 for providing a fluid path to a combustion chamber 46 of the engine 11. The controller 24 may be configured to selectively control relative amounts of the first flow 36 and the second flow 40 which are allowed to pass through the outlet 42 and to the combustion chamber(s) 46.

The combustion chamber 46 may be one or more combustion chambers 46 located in a respective number of cylinders 48. Four cylinders are shown in the illustrated example. Other example engines 11 in accordance with the present disclosure may have other numbers of cylinders, for example six, or eight cylinders. The cylinders 48 may be formed in an engine block 49. In the case of two or more cylinders fluidic communication to and from the cylinders may be via an intake manifold 49.

During the purging operation shown in FIG. 1B a vent 50 may allow fresh air to be drawn into evaporative canister 18. The vent 50 may include upstream vent passage 52 and downstream vent passage 54 gated by a vent valve 56 to allow fresh air to pass, or to prevent fresh air from passing to the evaporative canister 18. The vent valve 56 may be controlled by the controller 24.

The upstream vent passage 52 may have a different inner diameter than the inner diameter downstream vent passage 54. In some cases the upstream vent passage 52 inner diameter may be bigger than the downstream vent passage 54 inner diameter. The purged vapors may pass to the purge valve 30 via purge passage 58. In some embodiments the inner diameter of the purge passage 58 may be approximately the same as the upstream vent passage 52, and the downstream vent passage 54 inner diameter may be smaller than both the upstream vent passage 52 and the purge passage 58.

Some embodiments may include an additional purge passage 60. The additional purge passage 60 may provide fluidic communication between the evaporative canister 18 and the combustion chambers 46 via the intake manifold 49. Flow through the additional purge passage 60 may be regulated by an additional purge valve 62. The additional purge valve 62 may be controlled by the controller 24. In some cases the inner diameter of the additional purge passage 60 maybe smaller than the inner diameter of the purge passage 58. In embodiments including the additional purge valve, purge valve 30 may also be referred to as a primary purge valve.

Referring again to FIG. 1A wherein the example absorbing operational condition also shows an additional mechanism to absorb fuel vapors from other parts of the engine. In some embodiments the purge valve 30 may includes an operative position to allow hydrocarbons from the engine to migrate into the purge passage 58. The purge passage 58 may be a carbon lined purge hose 58 located between the evaporative canister 18 and the second inlet 38. The operative position may be effected when the engine is turned off. With some examples some, or all, of the fuel vapor 26 may flow, or migrate to the evaporative canister 18 to be absorbed therein; or in other examples some, or all, of the fuel vapor 26 may be absorbed within the purge passage 58. The purge passage 58 may include the same, or another, appropriate vapor absorbing material.

After the fuel vapors 26 and/or fuel from the engine fuel line are passed to the combustion chamber(s) 46 and combusted the exhausted product may pass to an exhaust 64 via exhaust manifold 66 to the atmosphere 68. The engine exhaust 64 may include one or more emission control devices 70, which may be mounted in a close-coupled position in the exhaust 64. The one or more emission control devices 70 may include a three-way catalyst, lean NOx trap, diesel particulate filter, oxidation catalyst, etc.

Figure 1C:
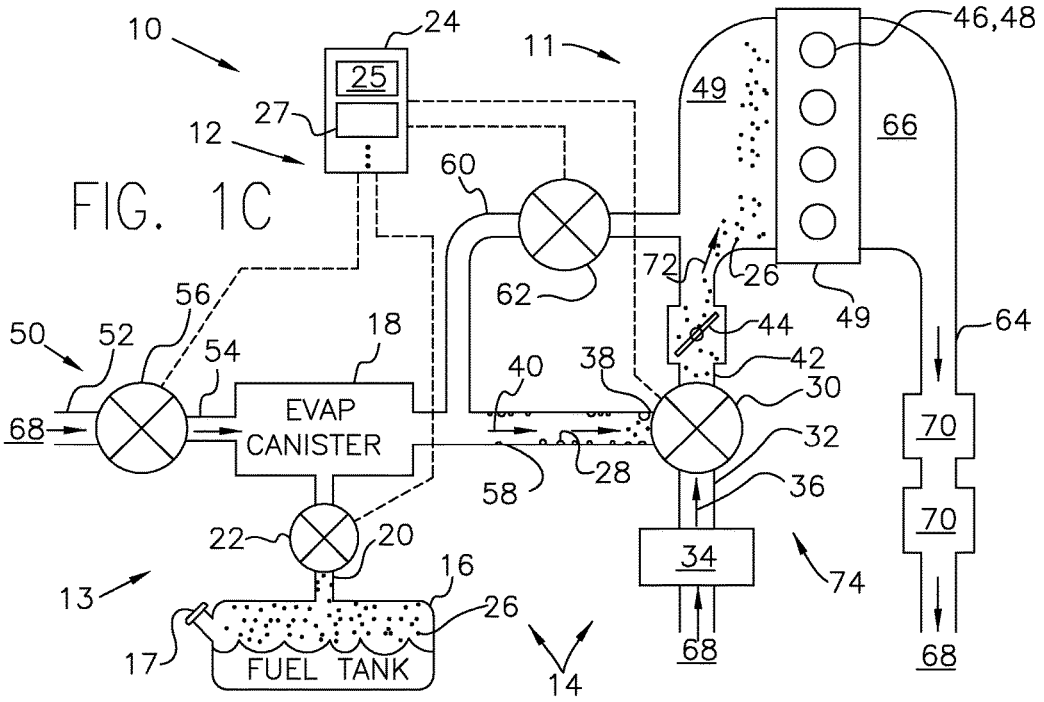

FIG. 1C illustrates an example operation of the valve 30. The valve 30 may be for an engine 11 and it may include a first inlet 32 for receiving atmospheric air 68 as a first flow 36, and a second inlet 38 for receiving a purge flow 40 from an evaporative canister 18 as a second flow 40. The evaporative canister 18 may be fluidically coupled with a fuel tank 16 and may be configured for absorbing fuel vapor 26. The purge flow 40 may include desorbed fuel vapor 26. The valve 30 may also include an outlet 42 for directing a selected mixture 72 of the first flow 36 and the second flow 40 to a combustion chamber 46 of the engine 11 in one or more preselected mixed ratios which may be balanced in accordance with predetermined conditions, or criteria. Accordingly, the purge valve 30 may be referred to as a balance purge valve 30.

Other illustrated features may be utilized in the operational state shown. The outlet 42 may be coupled with an induction air passage 74 upstream from the throttle 44. An air filter 34 may be located at an upstream end of the first flow 36. A canister vent valve 56 may be located upstream from the evaporative canister 18 for passing atmospheric air 68 into the evaporative canister 18 during a purging operation. An additional purge line 60 may fluidically couple a downstream side of the evaporative canister 18 to the intake manifold 49 downstream from the throttle 44.

Figure 1D:
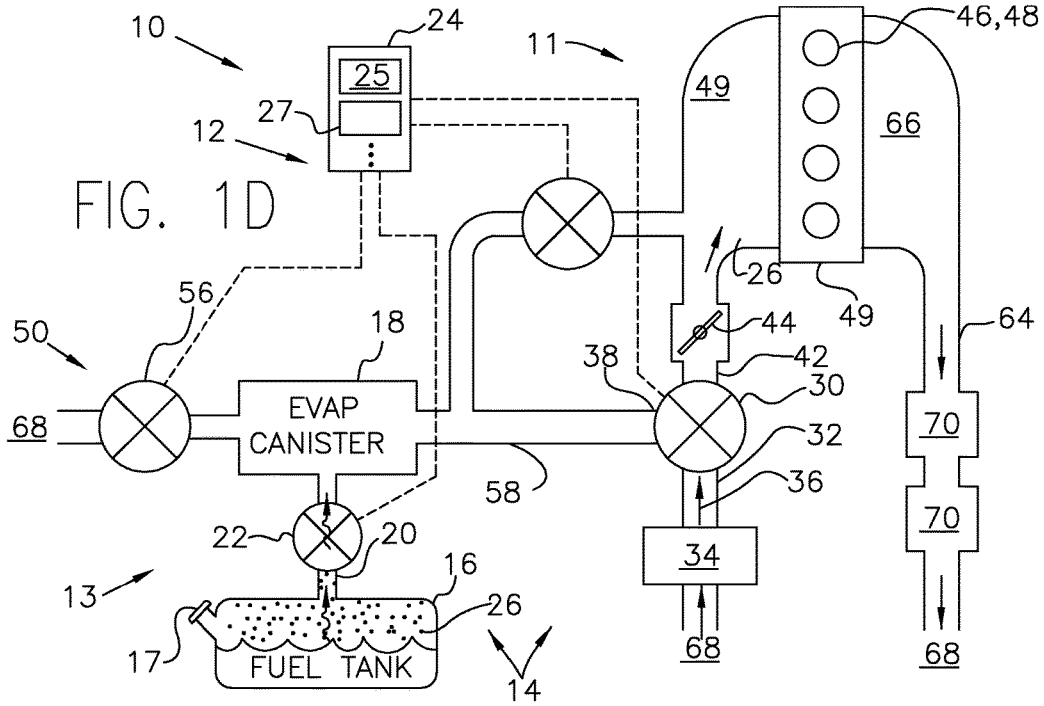

FIG. 1D illustrates another example operation of the valve 30. The valve 30 may be positioned to allow induction air to the intake manifold via only the first inlet 32.

Figure 2:
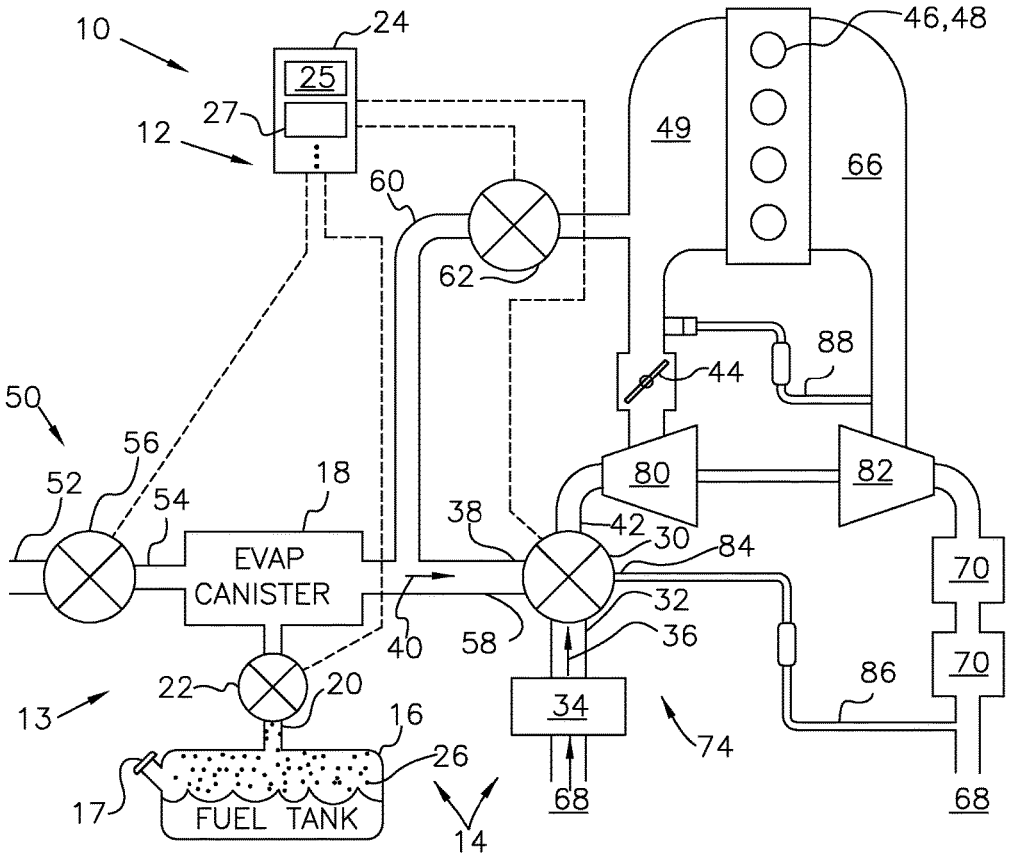
FIG. 2 is a schematic diagram illustrating another example embodiment in accordance with the current disclosure.

FIG. 2 is a schematic diagram illustrating another example embodiment in accordance with the current disclosure. A fuel vapor management system 14 for an engine 11 may include an evaporative canister 18 including a fuel vapor absorbing material. A turbo compressor 80 may be disposed on an induction air path 74 for compressing an induction fluid before the induction fluid is passed to an intake manifold 49 of the engine 11. The turbo compressor 80 may be driven by an exhaust turbine 82 which may be driven by exhaust gasses leaving the exhaust manifold 66. A valve 30 may be disposed on the induction air path 74 upstream from the turbo compressor 80. The valve 30 may have a first inlet 32 to receive a first flow 36, and may have a second inlet 38 to receive a second flow 40 from the evaporative canister 18. The valve may be controllable to adjust relative amounts of the first flow 36 and the second flow 40 to pass to the turbo compressor 80. A throttle 44 may be downstream from the turbo compressor 80.

An air filter 34 may be on the induction path 74 upstream from the first inlet 32 for filtering the first flow 36. There may be a purge line 58 between the evaporative canister 18 and the second inlet 38. The purge line 58 may also include a fuel vapor absorbing material. The valve 30 may be configured to selectively allow fuel vapors to migrate from the intake manifold 49 to the purge line 58.

In some embodiments the valve 30 may also include a third inlet 84 for receiving a third flow from an exhaust gas recirculation EGR line 86. In some embodiments, EGR line 86 may include an EGR valve for controlling flow of exhaust residuals therethrough. In addition, EGR line may include an EGR cooler for cooling the exhaust flow before delivery to the engine intake. The controller 24 may be further configured to selectively control an amount of exhaust gas to pass through the outlet 42 and to the combustion chamber 46. The EGR line 86, or passage, may be a low pressure EGR line 86. The engine system 12 may also include a high pressure EGR line 88.

Figure 3:
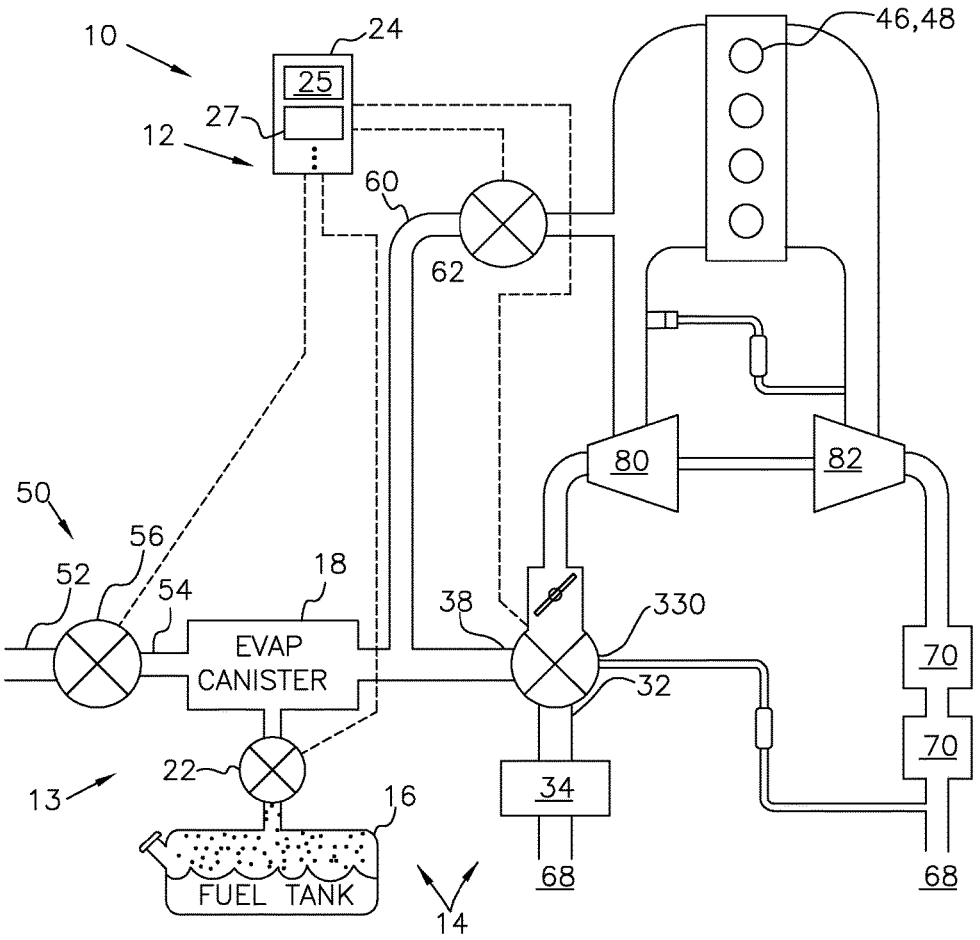
FIG. 3 is a schematic diagram illustrating yet another example embodiment in accordance with the current disclosure.

FIG. 3 illustrates another example embodiment in accordance with the present disclosure. In the illustrated embodiment the throttle may be made integrally with the purge valve in a common housing as a combined purge throttle valve 330.

Figure 4:
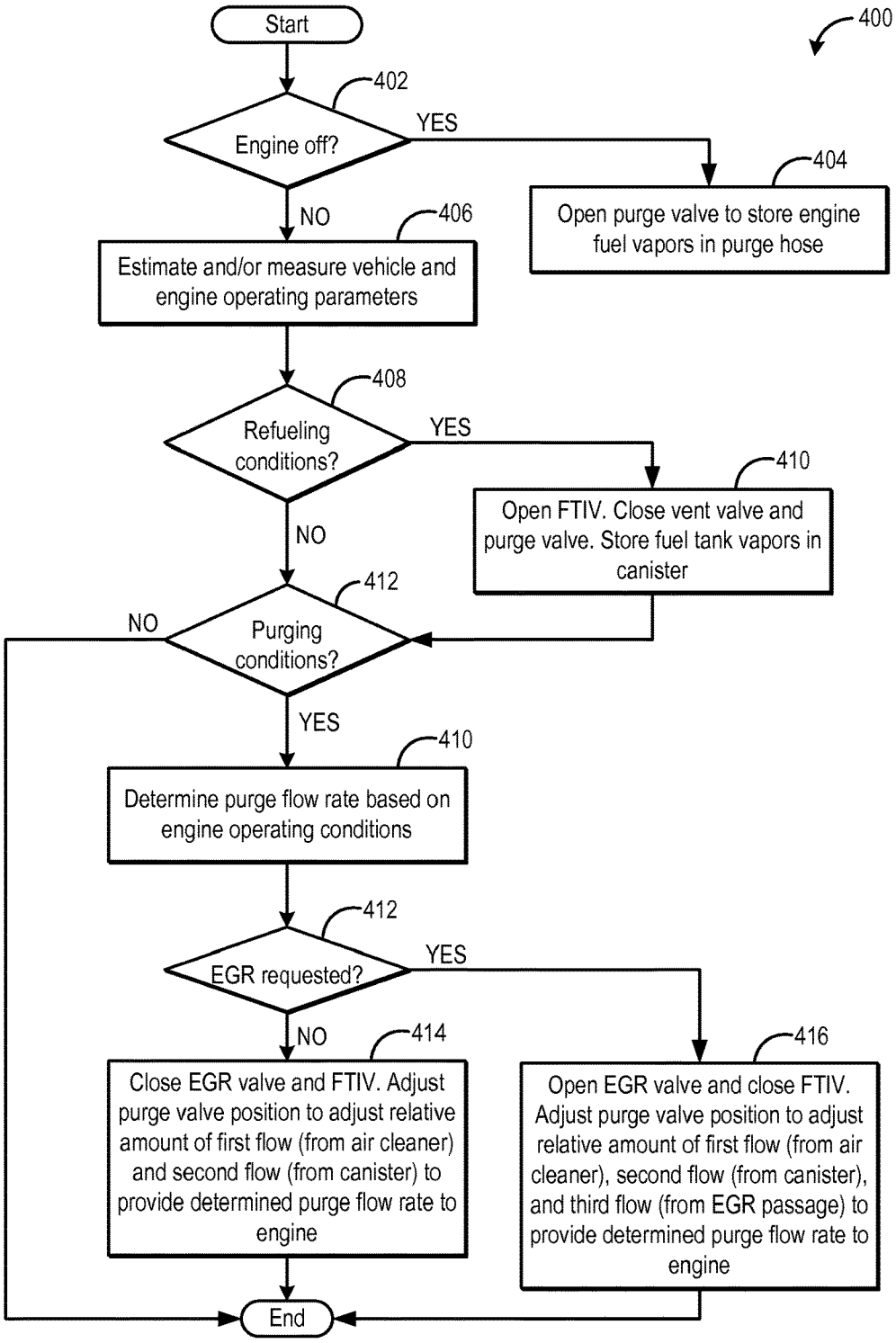
FIG. 4 is a high level flow chart of a method for adjusting the position of a purge valve of the engine system of FIGS. 1-3 to vary an amount of first, second, and/or third flow based on operating conditions.

Now turning to FIG. 4, an example method 400 is shown for adjusting a position of the purge valve of FIGS. 1-3 to vary an amount of first and second flow (and third flow) to provide a desired purge flow rate. The method enables an amount of fresh air received at the intake, from the air cleaner to be mixed with fuel vapors received from a canister, and optionally further mixed with exhaust residuals from an EGR passage. In this way, canister purging is enabled and a homogeneous purge mixture is provided to the engine.

At 402, it may be determined if the engine is off. For example, it may be determined if the vehicle is in a key-off position. If yes, then at 404, the method includes opening the purge valve to allow hydrocarbons from the engine to migrate into the purge passage. In embodiments where the purge passage is a carbon lined purge hose located between the evaporative canister and the second inlet of the purge valve, opening of the purge valve when the engine is turned off allows some, or all, of the fuel vapor from the engine to be absorbed in the purge passage. In addition, at least a portion of the engine fuel vapor may migrate to, and be stored in, the evaporative canister.

It will be appreciated that in alternate embodiments, such as where the purge passage is not lined with any adsorbent, the purge valve may be maintained closed during the engine off.

If the engine is not off, that is, the engine is running, then at 406, the method includes estimating and/or measuring vehicle and engine operating parameters. These may include, for example, engine speed, vehicle speed, driver torque demand, barometric pressure (BP), MAP, MAF, engine temperature, catalyst temperature, boost, battery state of charge, ambient conditions (temperature, humidity), canister hydrocarbon load, EGR demand, etc.

At 408, it may be determined if refueling conditions have been met. In one example, refueling conditions may be considered met if a fuel tank fuel level is less than a threshold, a canister hydrocarbon load is less than a threshold, and a fuel tank is being refilled with the engine not running. If refueling conditions are met, then at 410, the routine includes opening a fuel tank isolation valve (FTIV) to allow fuel tank refueling vapors to be directed into the fuel vapor canister, along a tank port of the canister, for storage in the canister. In addition, a vent valve and a purge valve coupled to the canister may be closed. In doing so, fuel vapor storage in the canister is improved and the engine intake manifold may be isolated from the refueling vapors. The valves may be maintained in their position until the refueling is completed at which time the FTIV may also be closed to isolate the fuel tank.

At 412, after refueling is completed, or if refueling conditions are not met (at 408), it may be determined if purging conditions have been met. In one example, purging conditions may be considered met in response to a canister hydrocarbon load being higher than a threshold load. In another example, purging conditions may be considered met if a threshold duration of vehicle (or engine) operation has elapsed since a last purging operation. Further still, purging conditions may be considered met if a threshold distance of vehicle (or engine) operation has elapsed since a last purging operation. If purging conditions are not met, the routine may end.

If purging conditions are met, then at 410, a purge flow rate may be determined based on the engine operating conditions. For example, based on the engine torque demand, intake manifold vacuum level, manifold flow rate, boost level, canister load, etc., a purge flow rate may be determined. As an example, a higher purge flow rate may be determined (and tolerated) when the engine is operating at higher engine speed-load conditions while a lower purge flow rate may be determined (and tolerated) when the engine is operating at lower engine speed-load conditions. As another example, a higher purge flow rate may be determined when the canister load is higher (to enable complete purging of the canister). As yet another example, a higher purge flow rate may be determined when the engine is operating boosted as compared to unboosted. The purge rate may be further adjusted based on the temperature of the canister and/or the temperature of the intake air. As such, at higher canister temperatures and higher intake air temperatures, desorbing of fuel vapors from the canister adsorbent is increased.

At 412, it may be determined if EGR is requested. For example, based on the engine operating conditions, it may be determined if engine dilution is required. In one example, by recirculating at least a portion of exhaust residuals from the engine exhaust manifold to the engine intake manifold, exhaust emissions may be lowered, and improvements in fuel economy may be achieved, especially at higher levels of engine boost.

If EGR is not requested, then at 414, the method includes closing an EGR valve in a (low pressure) EGR line coupling the exhaust manifold to the intake manifold (from downstream of a turbine to upstream of a compressor). In addition, the fuel tank isolation valve may be maintained closed to isolate the fuel tank from the canister during the purging. In addition, the vent valve coupled to the canister may be opened. By opening the vent valve, atmospheric air may be received in the canister, and the air may be used to desorb and purge the stored fuel vapors.

The controller may then adjust a position of the purge valve to adjust a relative amount (or ratio) of a first flow and a second flow to the purge valve. Herein, the first flow may include a first flow of fresh air received at the purge valve from the air cleaner while the second flow includes a second flow of fuel vapors received at the purge valve from the canister. By adjusting the position of the purge valve, an amount of intake air received from the air cleaner may be displaced by a corresponding amount of purge air received from the canister. For example, when a canister load is higher, and a higher purge rate is determined, a position of the purge valve may be adjusted so that a larger amount of second flow of fuel vapors is received from the canister and a correspondingly smaller amount of first flow of fresh intake air is received from the air cleaner. In an alternate example, when the canister load is lower, and a lower purge rate is determined, a position of the purge valve may be adjusted so that a smaller amount of second flow of fuel vapors is received from the canister and a correspondingly larger amount of first flow of fresh intake air is received from the air cleaner. The first and second flow may then be mixed at the purge valve, and a homogenous mixture of the first flow and the second flow may then be delivered to intake manifold. In this way, by adjusting the opening the purge valve to receive the fresh air flow and hydrocarbon flow in a controlled manner, fuel vapors stored along the entire length of the canister can be purged to the engine intake at the desired purge rate.

If EGR is requested, then at 416, the method includes opening the EGR valve in the (low pressure) EGR line coupling the exhaust manifold to the intake manifold (from downstream of a turbine to upstream of a compressor). In addition, the fuel tank isolation valve may be maintained closed during the purging. The controller may then adjust a position of the purge valve to adjust a relative amount (or ratio) of the first flow of fresh air received at the purge valve from the air cleaner, the second flow of fuel vapors received at the purge valve from the canister, and a third flow of exhaust gas received at the purge valve from the EGR line. By adjusting the position of the purge valve, an amount of intake air received from the air cleaner may be displaced by a corresponding combination of exhaust residuals received from the (low pressure) EGR line and purge air received from the canister. In this way, the desired purge rate as well the desired low pressure EGR rate (LP-EGR rate) may be provided.

In some embodiments, the purge rate may be adjusted based on the LP-EGR rate. For example, as the determined EGR rate increases, the purge rate may be decreased so as not to flood the engine with more fuel vapors than it can handle and to maintain a combustion air-fuel ratio (e.g., at or around stoichiometry). In still other embodiments, the LP-EGR rate may be adjusted based on the purge rate. For example, as the purge rate increases, the EGR rate may be decreased.

As one example, when the canister load is higher, and a higher purge rate is determined, a position of the purge valve may be adjusted so that a third flow from the EGR line corresponding to the desired EGR rate is received from the EGR line, while a larger amount of second flow of fuel vapors is received from the canister and a correspondingly smaller amount of first flow of fresh intake air is received from the air cleaner. In an alternate example, when the canister load is lower, and a lower purge rate is determined, a position of the purge valve may be adjusted so that the third flow from the EGR line corresponding to the desired EGR rate is received from the EGR line, while a smaller amount of second flow of fuel vapors is received from the canister and a correspondingly larger amount of first flow of fresh intake air is received from the air cleaner. The first, second, and third flow are then mixed at the purge valve, and a homogenous mixture of the first, second, and third flow is then delivered to the intake manifold.

It will be appreciated that while the above method suggests opening an EGR valve in the LP-EGR line and coordinating an opening of the EGR valve with an opening of the purge valve to provide a desired LP-EGR rate and a desired purge flow rate, in other embodiments where the EGR line does not include a dedicated EGR valve, the desired LP-EGR flow rate from the EGR line may also be provided by adjusting the position of the purge valve.

In some embodiments, where the EGR request includes a request for high pressure EGR (HP-EGR) received from the exhaust, upstream of the turbine, at the intake, downstream of the compressor and downstream of the purge valve, the purge rate may be further adjusted based on the HP-EGR rate. For example, as an amount or rate of HP-EGR flow received at the intake increases, a purge flow rate received from the purge valve may be decreased so as to maintain a combustion air-fuel ratio.

In embodiments where the engine system includes a primary purge valve as well as an additional purge valve (such as a primary purge valve 30 and an additional purge valve 62), the controller may adjust and coordinate the opening of the purge valves to provide the desired purge flow rate. For example, when the purge flow rate is higher than a threshold rate (or when the canister load is higher than a threshold load), the controller may open each of the primary and additional purge valves. Therein, as an example, as an opening of the additional purge valve is increased, the opening of the primary purge valve may be adjusted to decrease an amount of second flow received from the canister while maintaining the first flow received from the air cleaner (and EGR line). In some embodiments, a timing of opening the primary and additional purge valves may also vary. For example, when the determined purge flow rate is above a threshold rate (or the canister load is above a threshold load), the controller may first open the primary purge valve while keeping the additional purge valve closed and deliver purge flow to the engine until the desired purge flow rate is below the threshold rate (or until the canister load is below the threshold load). Then, the controller may open the additional purge valve and accordingly adjust the position of the primary purge valve. In alternate embodiments, the additional purge valve may be opened before the primary purge valve is opened.

In still further embodiments, the opening the additional purge valve may be based on the storing of engine fuel vapors in the canister and/or purge passage during engine off conditions. For example, the (primary) purge valve may be opened during engine off conditions and engine hydrocarbons may be stored in the canister and purge passage during the engine off. Then, during a first purging operation following the engine off condition, each of the additional purge valve and the primary purge valve may be opened to enable complete cleaning of the canister and the purge passage. In comparison, if the (primary) purge valve is not opened during engine off conditions and engine hydrocarbons are not stored in the canister and purge passage during the engine off, during a first purging operation following the engine off condition, only the primary purge valve may be opened to enable complete cleaning of the canister.

As such, the various fuel system valves may be maintained in their position until the purging is completed at which time the vent valve and the purge valve(s) may be closed.

It will be understood that the example engine 11 is shown, only for the purpose of example, and that the systems and methods described herein may be implemented in or applied to any other suitable engine having any suitable components and/or arrangement of components.

The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system Further still, it should be understood that the systems and methods described herein are exemplary in nature, and that these specific embodiments or examples are not to be considered in a limiting sense, because numerous variations are contemplated. Accordingly, the present disclosure includes all novel and non-obvious combinations of the various systems and methods disclosed herein, as well as any and all equivalents thereof.

The invention claimed is:

1. A fuel combustion engine comprising:

a purge line comprising a carbon lined purge hose;

a combined purge throttle valve comprising:

a purge valve having a first inlet for coupling with an air cleaner to receive a first flow from the air cleaner and a second inlet for coupling with an evaporative canister via the purge line to receive a second flow from the evaporative canister; and a throttle having an upstream side fluidically coupled to an outlet of the purge valve, the throttle providing a fluid path to a combustion chamber of the engine, the throttle integrally made with the purge valve in a common housing upstream of a turbo compressor;

an additional purge line fluidically coupled to the purge line between the evaporative canister and the second inlet and to an engine intake manifold downstream of the throttle;

an additional purge valve arranged in the additional purge line; and a controller with instructions to send a signal to the purge valve and the additional purge valve to selectively adjust relative amounts of the first flow and the second flow allowed to pass through the outlet and to the combustion chamber, wherein the purge valve includes an operative position to allow hydrocarbons from the engine to migrate into the carbon lined purge hose, and wherein the additional purge line has an inner diameter smaller than an inner diameter of the purge line.

2. The engine of claim 1, wherein the purge valve further comprises a third inlet coupled with an exhaust gas recirculation line, and wherein the controller further includes instructions to send a signal to the purge valve to selectively control an amount of exhaust gas to pass through the outlet and to the combustion chamber.

3. The engine of claim 1, wherein the controller further comprises instructions for determining if the engine is in an off condition, and if so, sending a signal to adjust the purge valve to the operative position to be open so fuel vapor migrates and is absorbed in the carbon lined purge hose.

4. The engine of claim 1, wherein the throttle is electronically controlled via a motor, the purge valve further comprising a third inlet, adjacent both the outlet and the second inlet, coupled with an exhaust gas recirculation line, and wherein the controller further includes instructions to send a signal to the purge valve to selectively control an amount of low pressure exhaust gas to pass through the outlet and to the combustion chamber.

5. The engine of claim 1, wherein the signal sent by the controller to the purge valve is responsive to selected engine conditions determined by one or more sensors.

6. The engine of claim 1, wherein the operative position is effected when the engine is turned off.

7. The engine of claim 1, wherein when a purge flow rate is above a threshold rate, the controller further comprises instructions to send a signal to first open the purge valve while keeping the additional purge valve closed and deliver purge flow to the engine intake manifold until a desired purge flow rate is below the threshold rate, and then send a signal to open the additional purge valve and adjust a position of the purge valve.

8. The engine of claim 1, wherein the purge valve has a third inlet for receiving a third flow from an exhaust gas recirculation (EGR) line of the engine, wherein the EGR line further includes an EGR cooler for cooling exhaust flow before delivery to an engine intake, wherein the controller is further configured to selectively control an amount of exhaust gas to pass through the outlet and to the combustion chamber of the engine, and wherein the EGR line is a low pressure EGR line.

9. The engine of claim 1, wherein the controller further comprises instructions to:

when a load of the evaporative canister is higher than a threshold, send a signal to the additional purge valve to increase opening of the additional purge valve and send a signal to the purge valve to adjust the purge valve to decrease an amount of the second flow received from the evaporative canister while maintaining the first flow into the first inlet of the purge valve.

10. A fuel vapor management system, comprising:

a purge valve arranged in an engine intake passage, the purge valve comprising:

a first inlet for receiving atmospheric air as a first flow;

a second inlet for receiving a purge flow from an evaporative canister as a second flow, the evaporative canister fluidically coupled with a fuel tank and configured for absorbing fuel vapor, the purge flow including desorbed fuel vapor; and an outlet for directing a selected mixture of the first flow and the second flow to an engine combustion chamber;

a purge line fluidically coupling a downstream side of the evaporative canister with the second inlet;

an additional purge line fluidically coupled to the purge line between the evaporative canister and the second inlet and to an engine intake manifold downstream of a throttle, wherein the additional purge line has an inner diameter smaller than an inner diameter of the purge line;

an additional purge valve arranged in the additional purge line; and a controller with instructions to send a signal to the purge valve and the additional purge valve to adjust and coordinate opening of the purge valve and the additional purge valve based on a desired purge flow rate.

11. The fuel vapor management system of claim 10, wherein the outlet is coupled with the engine intake passage upstream from the throttle, the throttle arranged upstream of a turbo compressor.

12. The fuel vapor management system of claim 11, wherein the controller further includes instructions to send a signal to open each of the purge valve and additional purge valve when a canister load is higher than a threshold load, wherein as an opening of the additional purge valve is increased, the opening of the purge valve is adjusted to decrease an amount of flow received from the evaporative canister while maintaining a flow received from an air cleaner at an upstream end of the first flow.

13. The fuel vapor management system of claim 10, wherein the controller further includes instructions to send a signal to vary a timing of opening the purge valve and additional purge valve, including instructions to, when a determined purge flow rate is above a threshold rate, send a signal to first open the purge valve while keeping the additional purge valve closed and delivering purge flow to an engine until the desired purge flow rate is below the threshold rate, and then send a signal to open the additional purge valve and accordingly adjust a position of the purge valve.

14. The fuel vapor management system of claim 10, further comprising a canister vent valve upstream from the evaporative canister for passing atmospheric air into the evaporative canister during a purging operation.

15. The fuel vapor management system of claim 10, wherein the purge valve further comprises a third inlet for receiving a third flow from an exhaust gas recirculation (EGR) passage.

16. The fuel vapor management system of claim 10, wherein the purge line includes a fuel vapor absorbing material, and wherein the purge valve is configured to selectively allow fuel vapors to migrate from the engine intake manifold to the purge line.

17. A fuel vapor management system for an engine comprising:

an evaporative canister including a fuel vapor absorbing material;

a turbo compressor on an induction air path for compressing an induction fluid before the induction fluid is passed to an intake manifold of the engine;

a purge valve on the induction air path upstream from the turbo compressor having a first inlet to receive a first flow of atmospheric air, and having a second inlet to receive a second flow from the evaporative canister;

the purge valve controllable to adjust relative amounts of the first flow and the second flow to pass to the turbo compressor;

a purge line between the evaporative canister and the second inlet and including a fuel vapor absorbing material, the purge valve configured to selectively allow fuel vapors to migrate from the intake manifold to the purge line;

an additional purge valve arranged in an additional purge line fluidically coupled to the purge line between the evaporative canister and the second inlet and to the intake manifold downstream of the turbo compressor, wherein the additional purge line has an inner diameter smaller than an inner diameter of the purge line; and a controller with instructions to:

in a first mode, send a signal to open the purge valve during an engine off condition, and during a first purging operation following the engine off condition, send a signal to open each of the additional purge valve and the purge valve; and in a second mode, send a signal to close the purge valve during the engine off condition, and during a first purging operation following the engine off condition, send a signal to open the purge valve and close the additional purge valve.

18. The fuel vapor management system of claim 17, further comprising an air filter on the induction air path upstream from the first inlet for filtering the first flow.

* * * * *